US008403329B2

(12) United States Patent
Krickovic

(10) Patent No.: US 8,403,329 B2
(45) Date of Patent: Mar. 26, 2013

(54) GAMING DEVICE FOR PELLET GUNS

(75) Inventor: Radomir Krickovic, Stukely Sud (CA)

(73) Assignee: Radomir Krickovic, Stukely-Sud, Quebec (CA)

( * ) Notice: Subject to any disclaimer, the term of this patent is extended or adjusted under 35 U.S.C. 154(b) by 276 days.

(21) Appl. No.: 12/932,317

(22) Filed: Feb. 24, 2011

(65) Prior Publication Data

US 2011/0227288 A1 Sep. 22, 2011

Related U.S. Application Data

(60) Provisional application No. 61/315,112, filed on Mar. 18, 2010.

(51) Int. Cl.
*F41J 5/14* (2006.01)

(52) U.S. Cl. ..... 273/385; 273/392

(58) Field of Classification Search ... 273/118 R–120 R, 273/127 D, 138.3, 383–387, 389–392, 404, 273/410
See application file for complete search history.

(56) References Cited

U.S. PATENT DOCUMENTS

| | | | | | |
|---|---|---|---|---|---|
| 202,255 | A * | 4/1878 | Gobbels | 273/385 |
| 1,573,645 | A * | 2/1926 | Rogers | 273/384 |
| 1,750,945 | A * | 3/1930 | Tratsch | 273/383 |
| 1,944,317 | A * | 1/1934 | Gustavson | 273/384 |
| 2,182,517 | A | 2/1939 | Compton | |
| 2,406,731 | A | 8/1946 | Amdur | |
| 3,262,704 | A * | 7/1966 | Abraham et al. | 273/385 |
| 3,561,761 | A * | 2/1971 | Klemma | 273/384 |
| 3,853,318 | A * | 12/1974 | Cagan | 273/379 |
| 3,936,052 | A * | 2/1976 | Hornsby, Jr. | 273/357 |
| 4,266,780 | A * | 5/1981 | McQuary | 273/387 |
| 4,524,976 | A * | 6/1985 | Seitz et al. | 273/388 |
| 4,662,846 | A * | 5/1987 | Quercetti | 434/96 |
| 5,280,919 | A | 1/1994 | Graham | |
| 5,342,062 | A | 8/1994 | Lance | |
| 5,597,164 | A | 1/1997 | Dodds | |

* cited by examiner

*Primary Examiner* — Mark Graham

(57) ABSTRACT

A Gaming Device for Pellet Guns is a portable, all mechanical, target apparatus used by one or more players. The device subassemblies may include a multiple silhouette targets housed in a pellet trap, a dispenser, and a score counter. The silhouette targets are mounted on pivoting posts. Its surface areas and shapes are consequential to the targeting challenge. The dispenser is designed to eject a ball from the magazine stack every time the target is hit. The ball color or its markings reflect the number of points scored. The score counter subassembly keeps a tally by stacking ejected balls into the score bar. The gaming device can take on various aesthetic themes that include a safari adventure, commando, space wars, the old west, and monsters. The unit can be built using variety of material including plastic, wood, or sheet metal. The construction methods may vary upon manufacturing.

5 Claims, 9 Drawing Sheets

GAMING DEVICE FOR PELLET GUNS

CROSS-REFERENCE TO RELATED APPLICATION

This application claims the benefits of PPA Ser. No. 61/315,112 filed 2010 Mar. 18 by present inventor.

BACKGROUND-PRIOR ART

The following is a tabulation of some prior art that presently appears relevant:

| Patent Number | Kind Code | US Patents Issue Date | Patentee |
|---|---|---|---|
| 5,342,062 | B1 | 1994 Aug. 30 | Lance |
| 5,280,919 | B1 | 1994 Jan. 25 | Graham |
| 2,182,517 | B1 | 1939 Feb. 20 | Compton/Silbereis |
| 2,406,731 | B1 | 1946 Aug. 27 | Amdur |
| 5,597,164 | B1 | 1997 Jan. 28 | Dodds |

A complete targeting system should offer a range of targeting challenges, show the target hits, auto reset the target after the strike, keep the score, maintain a history of successful hits, and facilitate the simplicity of operation. While many target systems have been designed in the past, the prior art arrangements have delivered desirable features only in part. For example, U.S. Pat. Nos. 5,280,919 (1994) and 5,342,062 (1994) do not have capability to keep the score. Another example, the U.S. Pat. No. 2,406,731 (1945) does not maintain the target strike history which is important in determining the make-up of the total score. The present invention incorporates all desirable features that are essential to an all-inclusive gaming device, and its advantages over the prior art will be rendered evident.

SUMMARY

A Gaming Device for Pellet Guns is a mechanical target that offers real life entertainment as opposed to virtual games. Pellet gun owners can aim at silhouette targets and engage in various fun games that can be played solo or with multiple players. This unique device provides instant gratification for good shooting by dispensing balls worth a designated amount of points for each successful hit. There is also the option of attaching a conventional paper target to the device for gun site alignment, target practice or competitive shooting. This device also promotes environmental responsibility by containing the lead pellet dispersion and reducing shooter's temptation to aim at wildlife. Air gun owners of any age could benefit from this novel gaming device.

DRAWINGS

Figure 3:
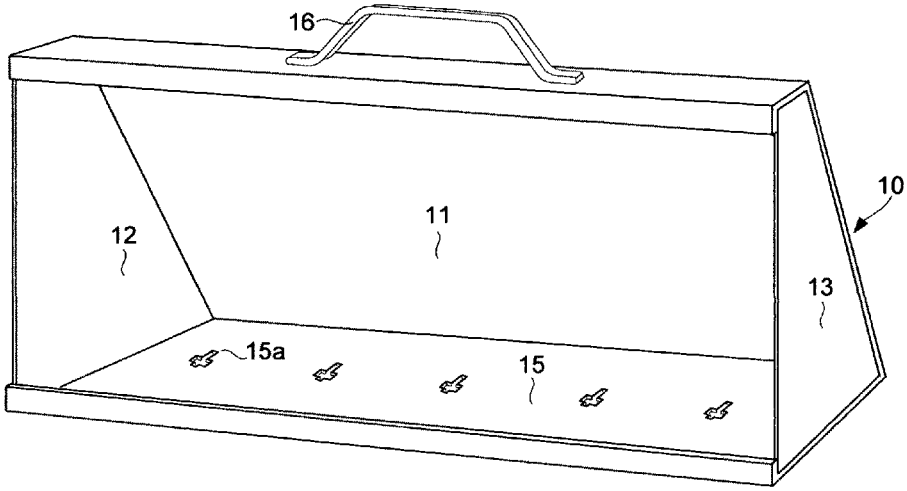
FIG. 3 is a perspective view of a pellet trap subassembly.
Figure 3A:
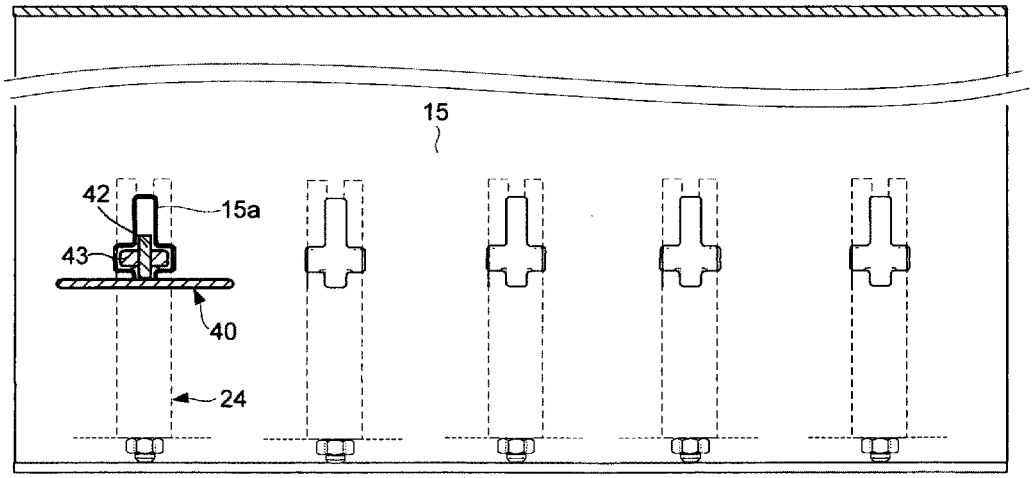

FIG. 3*a* is a plan view of a pellet trap bottom showing the cutouts for silhouette target insertion.

Figure 4:
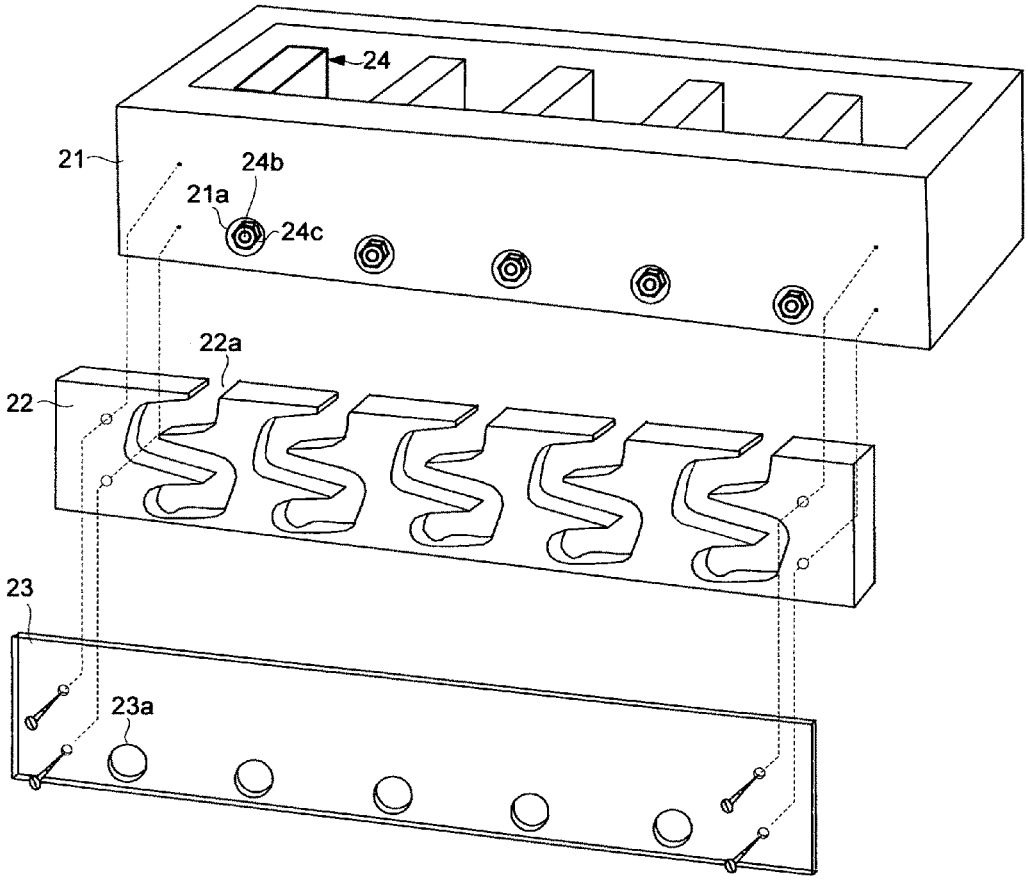

FIG. 4 is an exploded view of a dispenser subassembly

Figure 4A:
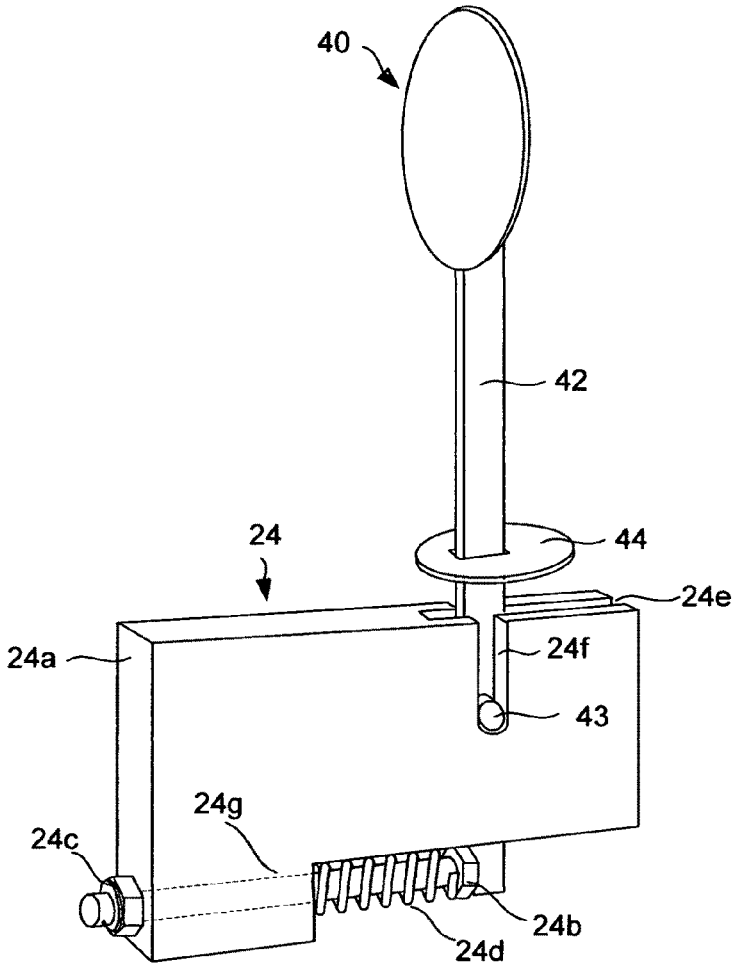

FIG. 4*a* is a perspective view detailing the silhouette target engaged with ejector subassembly.

Figure 4B:
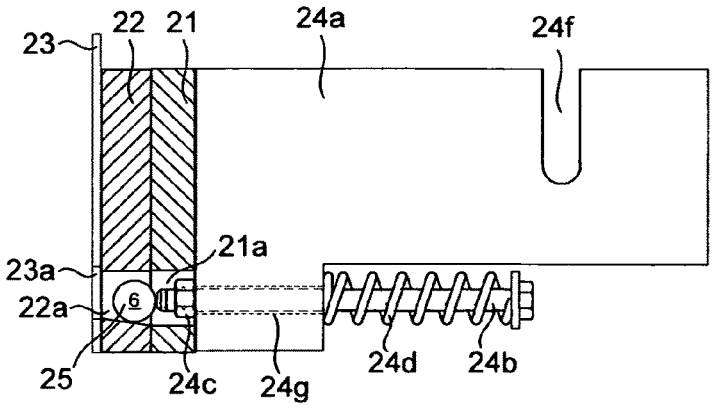

FIG. 4*b* is an elevation of ejector subassembly.

Figure 5:
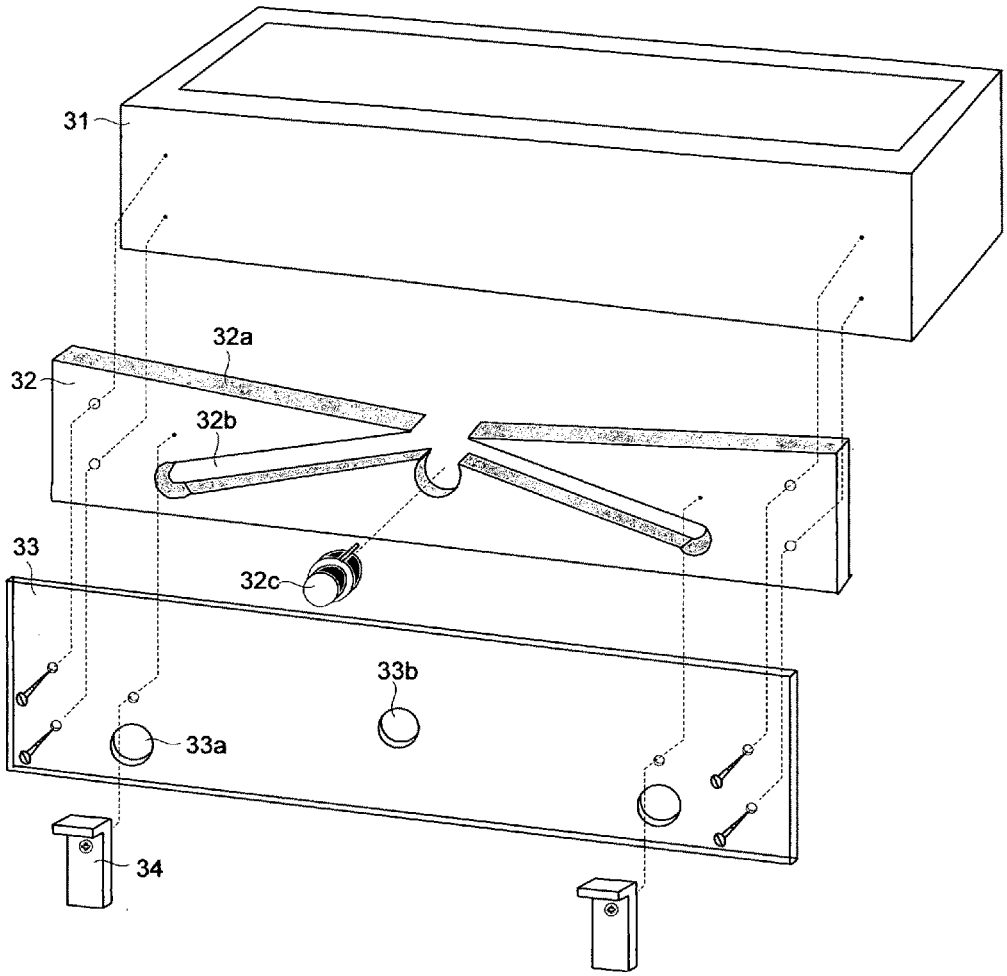

FIG. 5 is an exploded view of scoreboard subassembly

Figure 6:
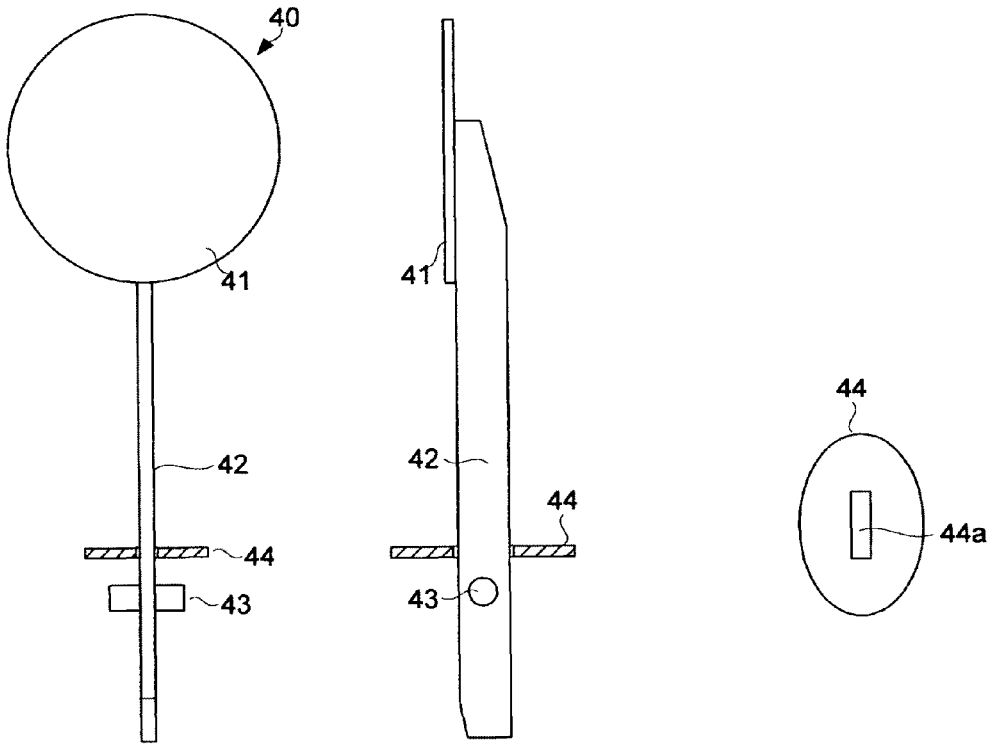

FIG. 6 details the silhouette target subassembly.

Figure 6A:
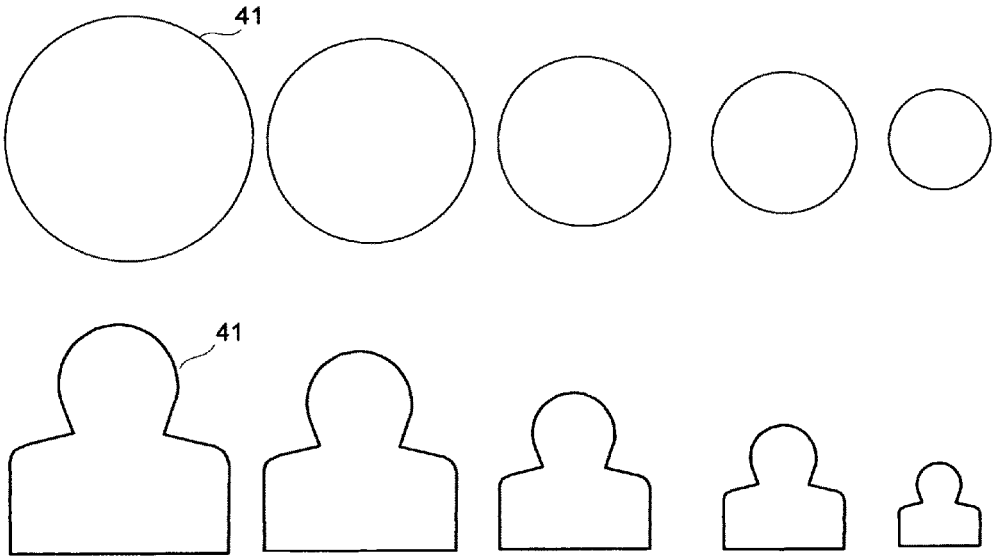

FIG. 6*a* shows the silhouettes having various shapes and sizes

Figure 7:
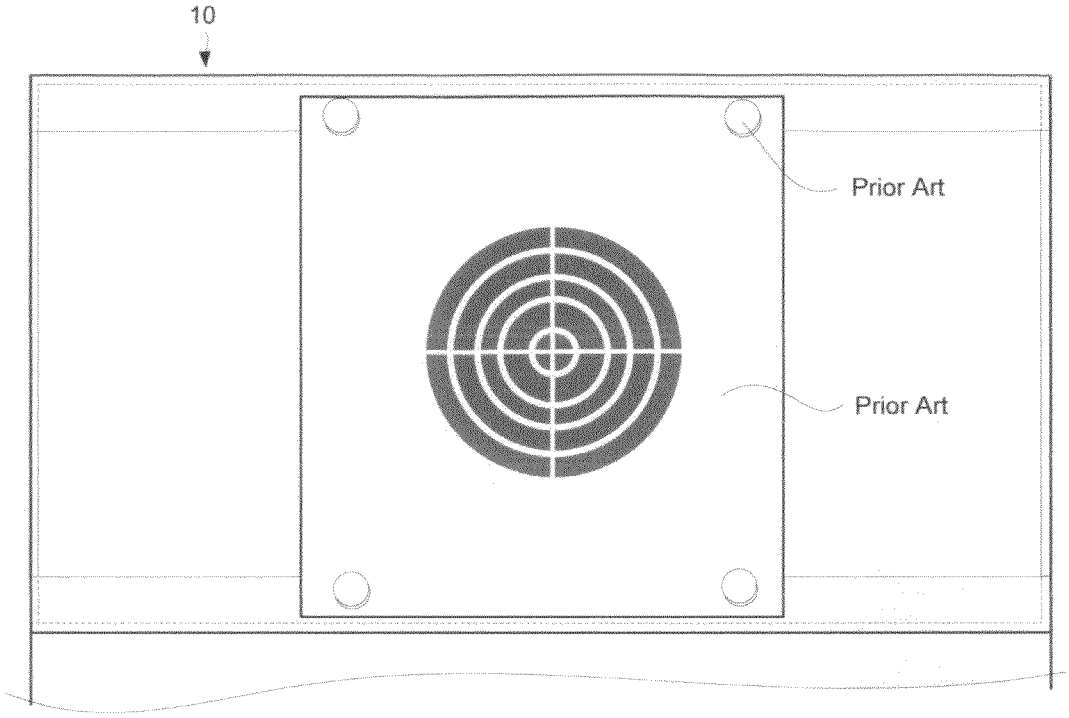

FIG. 7 shows how gaming device is used with paper target

DRAWINGS

REFERENCE NUMERALS

| |
|---|
| 10 Pellet trap subassembly |
| 11 Back segment |
| 12,13 Sides |
| 15 Bottom segment |
| 15a Cutout |
| 16 Carrying handle |
| 20 Dispenser subassembly |
| 21 Base |
| 21a Opening |
| 22 Repository board |
| 22a Magazine slot |
| 23 Cover plate |
| 23a Opening |
| 24 Ejector |
| 24a Ejector block |
| 24b Pushrod |
| 24c Locknut |
| 24d Spring |
| 24e Slot |
| 24f Pivot groove |
| 24g Guide hole |
| 25 Marble, ball |
| 30 Score counter subassembly |
| 31 Base |
| 32 Scoreboard |
| 32a Raceway |
| 32b Score bar |
| 32c Knob |
| 33 Cover plate |
| 33a Opening |
| 33b Opening |
| 34 Gate |
| 40 Target subassembly |
| 41 Silhouette |
| 42 Post |
| 43 Pivot bud |
| 44 Skirt |
| 44a Cutout |

DETAILED DESCRIPTION

FIGS. 1 to 6—Preferred Embodiment

Figure 1:
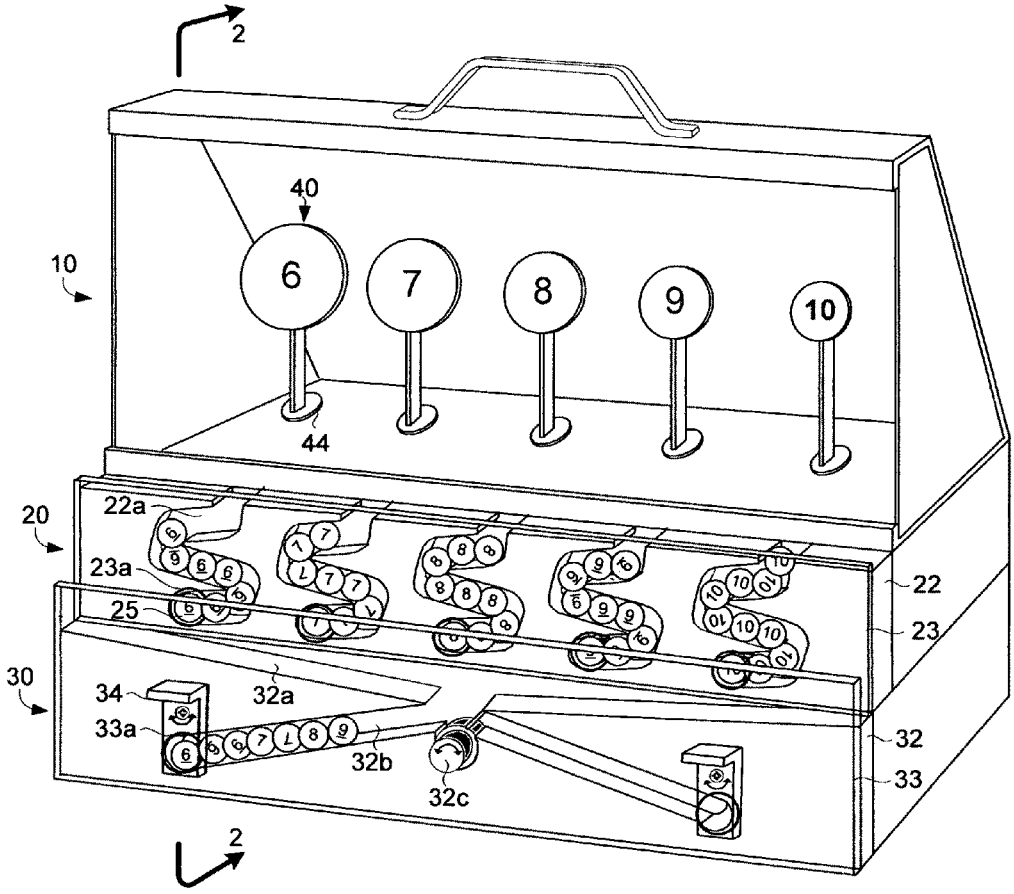
FIG. 1 is a perspective view of preferred embodiment of my invention.

Preferred embodiment of the gaming device is illustrated in FIG. 1 (perspective view) showing closely related subassemblies: a pellet trap 10, a dispenser 20, a score counter 30 and one or more targets 40. The subassemblies are integrated into an apparatus that can measure approximately 14"H×18"L×12"W for the unit comprising five targets.

The target subassembly 40 is detailed in FIG. 6. It comprises a silhouette 41, a post 42, pivot buds 43, and a skirt 44.

The silhouette 41 can be made from 14 gauge sheet metal and is attached to the post 42. When gaming device comprises more than one target, the face areas of silhouettes 41 can be graduated as shown in FIG. 6*a*. This facilitates different targeting challenge levels. Also, the silhouettes 41 can be contoured to reflect variety of gaming themes.

Figure 2:
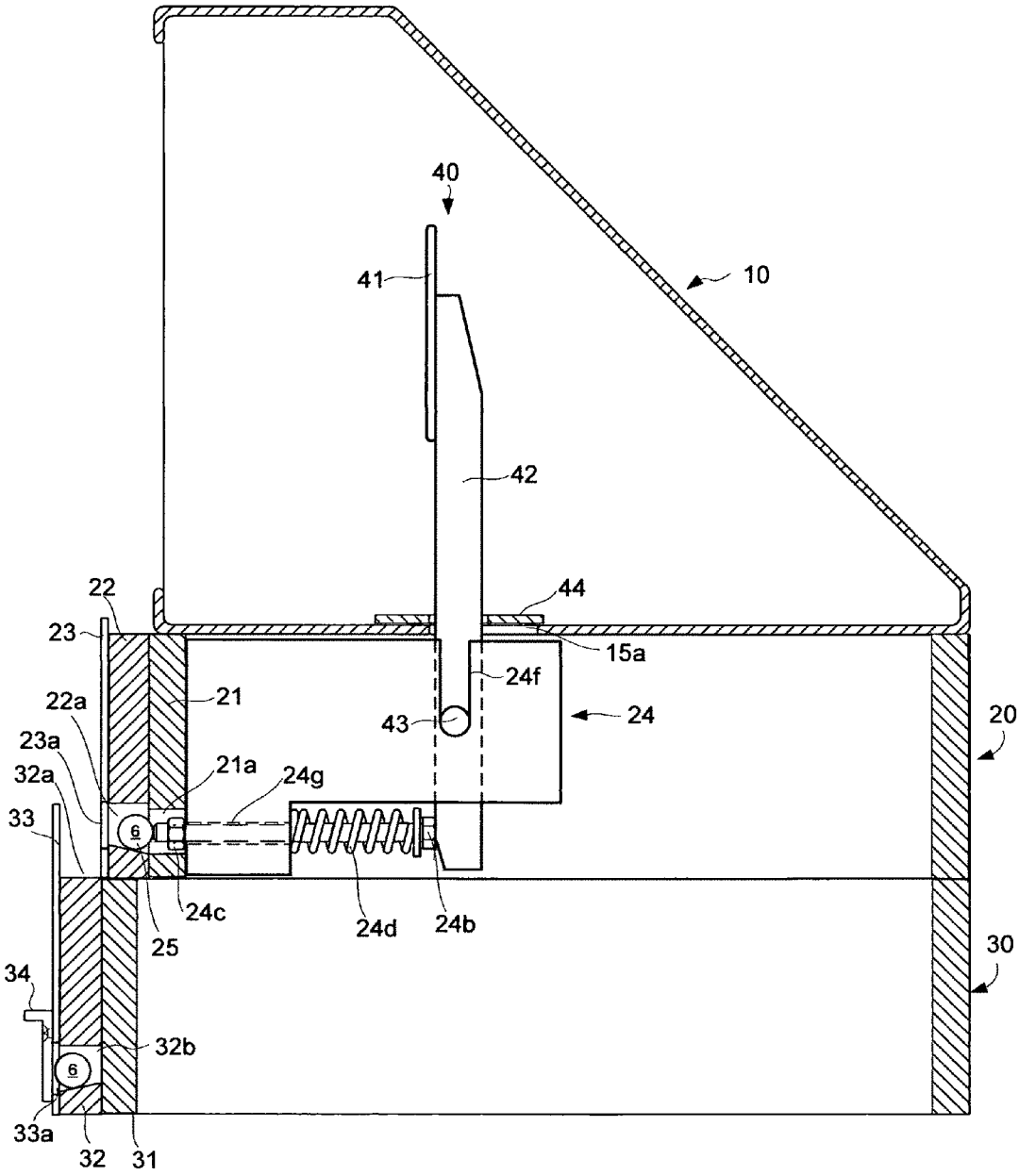
FIG. 2 is a view in detail of the portion indicated by the section lines 2-2 in FIG. 1.

Referring to FIG. 2, the length of the post 42 should be somewhat larger than the vertical distance between the axial centerline of the pushrod 24*b* and the mid height of the pellet trap subassembly 10. It can be made from 12 gauge thick, ½"

wide strip of sheet metal and slightly tapered at the bottom to ease the engagement with pushrod 24*b*.

The pivot buds 43 are cylinders made from either plastic or metal and can be attached to the post 42 with rivets or any other suitable method. They are positioned approximately ¼ length of the post 42 measured from the bottom. This ratio allows adequate outward movement of the pushrod 24*b* when the target subassembly 40 swings inward 10° or more.

The skirt 44, FIG. 6, is used to prevent jamming the target assembly 40 by rebound lead pellets. It can be made from the sheet metal and is sized to cover the gaps around the target post at insertion point. The cutout 44*a* is sized for loose fit of the skirt 44 over the post 42.

The target subassembly should be coated in an impact resistant and durable paint.

The pellet trap subassembly, FIG. 3, can be made of diverse materials like high impact plastic or adequately gauged sheet metal suitable for containing the kinetic energy of lead pellet. Different techniques can be employed in a pellet trap construction. The back 11 of the trap should be slopped, preferably 45°. The target insertion cutouts 15*a* are made at the bottom segment 15 of the trap, FIG. 3*a*, one for each target silhouette used in the device. The cutout 15*a* is contoured to clear the cross-section of the target post 42 and the pivot bud 43. It also extends beyond the target post 42 to allow 12-15° pivot of the target. The position of the cutouts 15*a* is predetermined by design and placement of ejector subassemblies 24 discussed later in the specification. The sides 12 and 13, FIG. 3, are shaped so to snugly fit the contour line formed by the bottom 15 and the back 11. Many methods can be used to fasten the sides 12 and 13 to the rest of subassembly. The carrying handle 16 can be made from the same material and attached to the top of the pellet trap. The pellet trap can be coated in an impact resistant and durable paint when required.

A dispenser, FIG. 4, comprises a base 21, a repository board 22, a cover plate 23, one or more ejector sub subassembly 24 and a plurality of balls 25 shown in FIG. 1.

A ball 25, FIG. 1, can be made of glass, plastic, or metal. There should be a number of balls 25 associated either by color or markings to each target subassembly 40.

A base 21, FIG. 4, is a frame like structure and can be made entirely or in part of plastic, wood, or sheet metal. The height of the base 21 should be sufficient to accommodate the magazine slots 22*a* having preferred holding capacity of 10 balls. The length and width of the base 21 are the same as the perimeters of the footprint of pellet trap subassembly shown in FIG. 3. The holes 21*a*, FIG. 4, are made on the face side of the base 21, one for each ejector 24. It is sized and positioned so to allow unobstructed movement of ejector pushrod 24*b* and locknut 24*c*, FIG. 4*b*.

A repository board 22, FIG. 4, can be made of similar material as the base 21. Its height and length is the same as the height and length of the base 21 and the thickness should be slightly greater than diameter of the ball 25, FIG. 4*b*. The repository board 22, FIG. 4, houses a magazine slot 22*a*, one for each ejector 24. The slot 22*a* should be slightly wider than the diameter of the ball; it is open on the top and can be straight, curved, or S-shaped to maximize the holding capacity of the balls. The bottom end of the magazine slots 22*a* should overlap with the holes 21*a*, FIG. 4*b*, and the lower edge should be slopped 5° to 8° toward back to prevent unintended rollout of the ball 25. Each magazine slot 22*a* should have holding capacity of 10 balls.

The cover plate 23, FIG. 4, can be made from transparent high impact plastic. Its height can exceed somewhat the height of repository board 22; however the length should be the same. The holes 23*a* are positioned at the bottom of each magazine slot 22*a* in a way not to obstruct the ball ejection.

An ejector 24 sub subassembly, FIG. 4*a*, is a receptacle for retractable target subassembly 40 allowing its post 42 to engage the pushrod 24*b*. The ejector 24 comprises of a block 24*a*, a pushrod 24*b*, a locknut 24*c*, and a spring 24*d*. The body 24*a* can be made entirely or in part of plastic, wood, or sheet metal. The pushrod 24*b* can be a hex bolt having ¼" shank with ¾" long threaded end. Referring to the FIG. 2, the overall length of the pushrod is equal to a horizontal distance between the face side of the dispenser base 21 and the front edge of the post 42 in vertical position. The compression spring 24*d* is positioned over the pushrod 24*b* which is then inserted in the guide hole 24*g*. The locknut 24*c* is tightened until the threaded tip of the pushrod 24*b* protrudes somewhat less than the thickness of the face side of the base 21. The spring 24*d* should be slightly compressed. The width of the pivot groove 24*f* is somewhat larger than the diameter of the pivot bud 43. The grove 24*f* is positioned to keep the silhouette 41 on horizontal centerline of the pellet trap 10 while maintaining the bottom of the post 42 engaged with the pushrod 24*b*. The slot 24*e*, FIG. 4*a*, is slightly wider than the thickness of the post 42. It projects across the full height of ejector block 24*a* starting at the back and continues until it passes the pivot groove 24*f* enough to allow 12-15° pivot of the target subassembly 40.

A score counter subassembly, FIG. 5, comprises a base 31, a scoreboard 32, and a cover plate 33.

The base 31 is a frame like structure and can be made entirely or in part of plastic, wood, or sheet metal. The length and width are the same as a footprint of dispenser subassembly 20, FIG. 1. The height of the base 31 should the same as the height of the scoreboard 32, FIG. 5.

The scoreboard 32 can be made of similar material and the same length as the base 31. The height of the scoreboard 32 is affected by design choices of raceway 32*a* and score bars 32*b* in terms of angle, shape, or number. The thickness of the scoreboard 32 is slightly greater than the diameter of the balls. The raceway 32*a* is tilted from outer edges toward the midpoint of the scoreboard 32. There is at least one sloped score bar slot 32*b* with preferred holding capacity of 10 or more balls. The lower edge at the bottom of the score bar 32*b* is sloped outward to ease the ball rollout. Should design incorporate more than one score bar 32*b*, the selector knob 32*c* can be used to select the score bar for subsequent players.

The cover plate 33 can be made from transparent, high impact plastic. Its length is the same as the length of the score board 32; however the height is extended as shown in FIG. 2 to keep the ejected balls on the raceway 32*a*. The openings 33*a* in FIG. 5 are positioned so to ensure that the bottom ends of the score bars 32*b* are unobstructed. The opening 33*b* is positioned over the selector knob 32*c*. The marble release gate 34 can be made of the same material as the cover plate 33. Turning the gate 34 around its fastener, it can be positioned to either expose or cover the opening 33*a*.

Operation—FIGS. 1, 2 and 7

The first step is preparation of the gaming device for use. Referring to FIG. 2, each target subassembly 40 is inserted in corresponding cutout 15*a* so that the pivot bud 43 slides all the way into pivot groove 24*f* causing the target post 42 to engage the pushrod 24*b*. The slightly compressed spring 24*d* keeps the target subassembly 40 in upright position against the front edge of cutout 15*a*. Being loose, the skirt 44 slides down along the post 42 and covers cutout 15*a*. This prevents jamming of target subassembly 40 by ricochet lead pellets. Next, any balls retained in the score bar 32*b*, FIG. 1, are released by turning the gate 34 so to uncover the opening 33*a*. After emptying the score bars 32*b*, the gate 34 is turned back to cover the opening 33*a*. Then the balls 25 are loaded from the top into magazine slots 22*a* taking care that its colors or markings correspond to target subassembly 40. The knob 32*c* is positioned to select the score bar 32*b* for the first player.

When a lead pellet hits silhouette 41, FIG. 2, the upper arm of the post 42 swings inward around the pivot bud 43. The lower arm moves in opposite direction driving the pushrod 24*b* outward while compressing the spring 24*d*. Consequently, the ball 25 at the bottom of the magazine slot 22*a* is pushed out. The spring 24*d* rebounds forcing the pushrod 24*b* and the target subassembly 40 to its initial position. This causes the balls 25 in the magazine slot 22*a*, FIG. 1, to move down by one place. Kept on the raceway 32*a* by the top edge of cover plate 33, the dispensed ball rolls into the score bar 32*b* relevant to the position of knob 32*c*. Should there be more than two players in the game; the score bar with lower score is emptied and the knob 32*c* is positioned to select it for subsequent player. The balls in the score bar with higher count are kept as a tally to beat.

To use the gaming device with a paper target, FIG. 7, the target silhouette subassemblies are removed from the pellet trap 10 prior to attaching the paper target on the face of the trap using magnets or masking tape.

I claim:

1. A gaming device for pellet gun, comprising:

a. a plurality of targets, each including a silhouette mounted on a pivoting post; and b. a pellet trap of predetermined size made of materials suitable for containing kinetic energy of a lead pellet and adapted to house a plurality of said targets; and c. a dispenser of predetermined size made entirely or in part of plastic, wood, or sheet metal, mounted underneath said pellet trap; holding a plurality of balls and adapted to eject one of said balls every time one off said targets is hit; and d. a score counter of predetermined size made entirely or in part of plastic, wood, or sheet metal, and mounted underneath said dispenser; enabled to collect and display said balls ejected by said dispenser.

2. The gaming device claimed in claim 1 further including a cutout, for allowing movement of each target post.

3. The gaming device claimed in claim 1, further comprising:

a. for each a magazine, said target, with a holding capacity of a plurality of balls; and b. an ejector, one per said target, mechanically engaged with said target and enabled to dispense a said ball from said magazine when said target pivots after being hit by a lead pellet.

4. The game device claimed in claim 1 wherein the balls are made of material selected from the group consisting of plastic, glass, rubber, or metal and include markings relating said ball to a particular said target worth a designated amount of points.

5. The gaming device claimed in claim 3, further comprising:

a. said score counter including a score bar enabled to hold balls dispensed by said ejector; and b. means for guiding said balls to said score bar; and c. means for releasing said balls from said score bar.

* * * * *